US008525747B2

(12) United States Patent
Focke et al.

(10) Patent No.: US 8,525,747 B2
(45) Date of Patent: Sep. 3, 2013

(54) SCANNING ANTENNA

(75) Inventors: Thomas Focke, Ahrbergen (DE); Joerg Hilsebecher, Hildesheim (DE); Oliver Lange, Hannover (DE); Reinhard Meschenmoser, Hannover (DE); Arne Zender, Bad Salzdetfurth (DE); Thomas Schoeberl, Hildesheim (DE); Thomas Hansen, Hildesheim (DE); Joachim Selinger, Stuttgart (DE); Karl Schneider, Burgstetten (DE)

(73) Assignee: Robert Bosch GmbH, Stuttgart (DE)

( * ) Notice: Subject to any disclaimer, the term of this patent is extended or adjusted under 35 U.S.C. 154(b) by 297 days.

(21) Appl. No.: 12/966,147

(22) Filed: Dec. 13, 2010

(65) Prior Publication Data

US 2011/0156973 A1 Jun. 30, 2011

(30) Foreign Application Priority Data

Dec. 29, 2009 (DE) ..... 10 2009 055 345

(51) Int. Cl.
*H01Q 13/10* (2006.01)

(52) U.S. Cl.
USPC ..... 343/770; 343/700 MS; 343/725; 343/771

(58) Field of Classification Search
USPC ..... 343/700 MS, 725, 770, 771, 753
See application file for complete search history.

(56) References Cited

U.S. PATENT DOCUMENTS

| | | | | |
|---|---|---|---|---|
| 4,742,355 | A | 5/1988 | Wolfson et al. | |
| 4,868,574 | A | 9/1989 | Raab | |
| 4,912,474 | A | 3/1990 | Paturel et al. | |
| 5,977,924 | A * | 11/1999 | Takei et al. | 343/770 |
| 6,388,621 | B1 * | 5/2002 | Lynch | 343/700 MS |
| 6,674,406 | B1 * | 1/2004 | Tonn | 343/700 MS |

FOREIGN PATENT DOCUMENTS

| | | |
|---|---|---|
| DE | 10 2007 056 910 | 5/2009 |
| GB | 935078 | 8/1963 |
| GB | 2 235 092 | 2/1991 |
| WO | 95/20169 | 7/1995 |

* cited by examiner

*Primary Examiner* — Tan Ho
(74) *Attorney, Agent, or Firm* — Kenyon & Kenyon LLP

(57) ABSTRACT

An antenna has an antenna body having a plurality of first antenna elements situated along a first straight line. The antenna body includes a first conductive grounded surface and a second conductive grounded surface, the first and second grounded surfaces being situated essentially parallel to one another. A dielectric is situated between the first and second grounded surfaces. A signal conductor is also situated between the first and second grounded surfaces. The first antenna elements are designed as apertures situated above the signal conductor in the first grounded surface. Furthermore, the antenna is designed to emit a signal in a direction in space, depending on a frequency of the signal. At least two of the first antenna elements differ from one another in such a way that their power emissions are different.

14 Claims, 9 Drawing Sheets

SCANNING ANTENNA

RELATED APPLICATION INFORMATION

The present application claims priority to and the benefit of German patent application no. 10 2009 055 345.2, which was filed in Germany on Dec. 29, 2009, the disclosure, of which is incorporated herein by reference.

FIELD OF THE INVENTION

The present invention relates to an antenna.

BACKGROUND INFORMATION

Radar systems use antennas to emit radar beams. There are known radar systems which scan a visible range using a bundled radar beam. This requires an antenna which emits only in a narrowly defined direction in space. In addition, this direction of emission must be variable in order to allow sequential scanning of the visible range. Antennas suitable for this purpose are also known as scanners.

In addition, there are known antennas whose emission direction depends on the frequency of the radar beam emitted. Such antennas are understood to be frequency scanners and are discussed in WO 95/20169 and DE 10 2007 056 910.8, for example. However, frequency-scanning antennas known so far are complex and expensive to manufacture and offer only a suboptimal directional characteristic, i.e., beam bundling.

SUMMARY OF THE INVENTION

An object of the exemplary embodiments and/or exemplary methods of the present invention is therefore to provide an improved antenna. This object is achieved by an antenna having the features described herein. Further refinements are described herein.

An antenna according to the present invention has an antenna body having a plurality of first antenna elements, which are situated along a first straight line. The antenna body includes a first conductive grounded surface and a second conductive grounded surface, the first and second grounded surfaces being situated essentially parallel to one another. A dielectric is situated between the first and second grounded surfaces. Furthermore, a signal conductor is situated between the first and second grounded surfaces. The first antenna elements are designed as apertures in the first grounded surface situated above the signal conductor. Furthermore, the antenna is designed to emit a signal in a direction which depends on a frequency of the signal. A distinction is made between at least two of the first antenna elements in relation to one another, such that they emit at different power levels. The antenna configuration of the antenna may advantageously be optimized by this design of the first antenna elements, so that a particularly favorable emission characteristic is achievable.

The power emitted by the first antenna elements in particular may cause interference in that side-lobe suppression of the emitted power amounts to more than 25 dB in the far field.

The first antenna elements expediently include an exterior antenna element and a central antenna element, the aperture forming the exterior antenna element having a first diameter, and the aperture forming the second antenna element having a second diameter. The first and second diameters are different. The antenna configuration may then advantageously be set via the size of the hole.

The first antenna elements in particular which may be include a central first antenna element, the power emitted by a first antenna element being approximately proportional to the square of the cosine of the distance of this first antenna element from the central first antenna element, normalized to n/2. Tests and calculations have advantageously shown that a particularly favorable emission characteristic of the antenna is achievable by using such an antenna configuration.

The signal conductor which may be has at least one compensation structure designed in such a way that interference in the signal conductor caused by reflection on the first antenna elements is compensated. It is advantageously possible to improve the antenna emission characteristic in this way.

In a further refinement, the antenna has a lens the shape of a cylindrical segment. A longitudinal axis of the lens is oriented parallel to the first straight line. Furthermore, the lens is made of a dielectric material. The beam emitted by the antenna is therefore advantageously focusable in a direction perpendicular to the antenna swiveling direction. This increases the antenna gain.

The lens is expediently made of polyetherimide. This material has advantageously proven to be particularly suitable.

In a further refinement, the antenna has a plurality of second antenna elements situated outside of the first straight line. The second antenna elements are designed as patch elements and at least two of the second antenna elements are interconnected by a microstrip conductor. The second antenna elements may then be used advantageously for detecting a reflected radar signal and thereby improve the antenna resolution in a direction perpendicular to the antenna swiveling direction.

The second antenna elements may also be used for emitting a radar signal.

The second antenna elements are which may be situated in a row oriented parallel to the first straight lines. The second antenna elements in the row are interconnected by a microstrip conductor. This design is advantageously suitable in particular for detecting the reflected signal, but may also be used for emitting a radar signal.

In an additional further refinement, the antenna includes a second antenna body having a plurality of third antenna elements situated along a second straight line. The second straight line is oriented parallel to the first straight line. Furthermore, a waveguide running between the third antenna elements is situated in the second antenna body. Furthermore, the third antenna elements are designed as apertures running between the waveguide and a surface of the second antenna body. Either the second antenna body may then advantageously be used for detecting a reflected radar signal, so that antenna resolution is improved in a direction perpendicular to the antenna swiveling direction, or the signals emitted by the first and second antenna bodies may interfere so as to yield improved focusing perpendicular to the antenna swiveling direction.

In yet another further refinement of the antenna, at least one antenna gap is provided with a plurality of fifth antenna elements, such that the antenna gap is oriented perpendicularly to the first straight line and the antenna gap is coupled to a first antenna element via a coupling structure. The antenna gap then advantageously causes the signal emitted by the antenna to focus in a direction perpendicular to the antenna swiveling direction. This improves the emission characteristic of the antenna.

According to one specific embodiment, the antenna gap is designed as a microstrip conductor antenna, the fifth antenna elements being designed as patch elements. Advantageously, the antenna gap may then be manufactured easily and inexpensively.

A substrate is expediently provided between the antenna body and the antenna gap. The substrate advantageously provides electric insulation of the antenna gap from the antenna body.

According to an alternative specific embodiment, the antenna gap is designed as a waveguide, the fifth antenna elements being designed as apertures in this waveguide. Such an antenna gap designed as a waveguide advantageously also causes the signal emitted by the antenna to focus in a direction perpendicular to the antenna swiveling direction.

The exemplary embodiments and/or exemplary methods of the present invention is explained in greater detail below on the basis of the appended figures. The same reference numerals are used for the same elements or those having the same effect.

DETAILED DESCRIPTION

Figure 1:
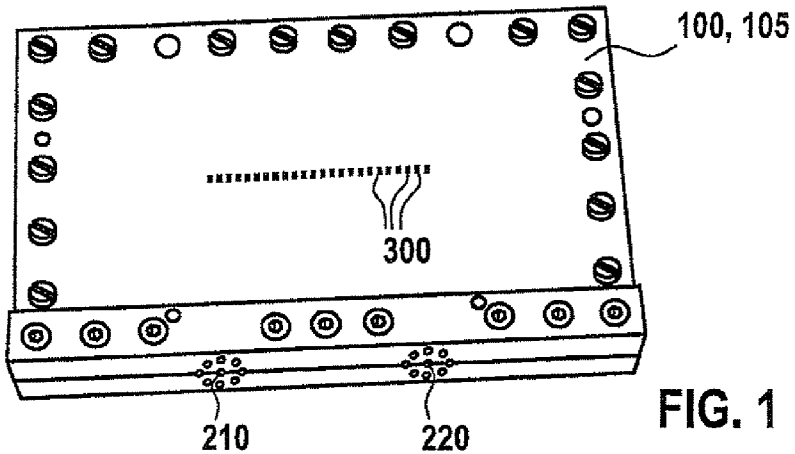
FIG. 1 shows a perspective view of an antenna body of an antenna.
Figure 2:
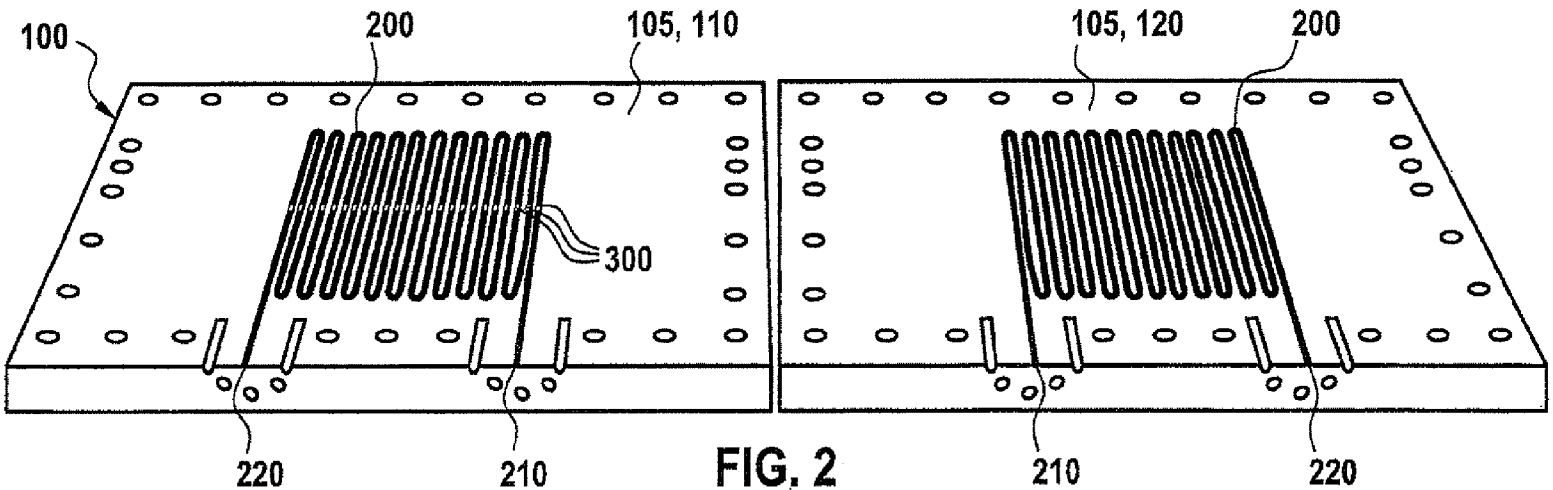
FIG. 2 shows a perspective view of the opened antenna body having a waveguide situated internally.

FIGS. 1 and 2 show perspective views of an antenna body 105 of an antenna 100. Antenna body 105 has a top part 110 and a bottom part 120. In the representation in FIG. 1, top part 110 and bottom part 120 of antenna body 105 are joined by screws. FIG. 2 shows top part 110 and bottom part 120 of antenna body 105 in an unconnected state. Top part 110 and bottom part 120 are each designed essentially as flat parallelepipeds. Top part 110 and bottom part 120 of the antenna body may be joined in such a way that a surface of top part 110 comes into contact with a surface of bottom part 120.

The surfaces of top part 110 and bottom part 120, which may be joined to one another, each have a meandering groove-type indentation. If top part 110 and bottom part 120 are joined together, the groove-type indentations supplement one another to form a waveguide 200 running in the interior of antenna body 105. Waveguide 200 runs between inlet 210 situated on an edge of antenna body 105 and an outlet 220 situated on the same edge of antenna body 105. A high-frequency electromagnetic signal may be injected into and extracted out of waveguide 200 via inlet 210 and outlet 220. The signal may have a frequency of 77 GHz, for example. The frequency may be varied by an amount of 2 GHz, for example, for swiveling of the radar beam emitted by antenna 100.

Top part 110 of antenna body 105 has a plurality of first antenna elements 300 situated along a straight line. First antenna elements 300 are designed as apertures running between an exterior surface of antenna body 105 and waveguide 200 in the interior of antenna body 105. This straight line, along which first antenna elements 300 are situated, runs parallel to the direction of extent of meandering waveguide 200. Each bend of meandering waveguide 200 has an aperture forming an antenna element 300. Antenna elements 300 are each situated centrally between two successive bends of waveguide 200. However, it is also possible for antenna elements 300 to be situated in other positions of waveguide 200, for example, in the vicinity of or directly on the bends in the meandering course of waveguide 200. For example, 24 or 48 or some other number of antenna elements 300 may be provided. The direct distance between two neighboring antenna elements 300 is selected as a function of the frequency of the signal to be emitted into waveguide 200 and may correspond to approximately half the wavelength of the signal, for example. The length of waveguide 200 between two neighboring antenna elements 300 is larger due to the meandering shape of waveguide 200 and may correspond to 5.5 times the wavelength of the signal, for example.

Antenna body 105 includes an electrically insulating material coated with a conductive material. The electrically insulating material may be, for example, a plastic, which may be polyetherimide or polybutylene terephthalate. In this case, antenna body 105 may be manufactured by an injection molding method. Alternatively, antenna body 105 may also be made of a glass. In this case, antenna body 105 may be manufactured by an embossing method, for example. Antenna body 105 may also be made of some other insulating material. A coating of a conductive material is applied to the insulating material of antenna body 105. This is necessary in order for waveguide 200 to be suitable for transmission of an electromagnetic wave. The conductive coating may include different layer combinations and materials. A coating with gold or aluminum only a few micrometers thick has proven to be very suitable. The coating may be applied by physical gas phase deposition or by a galvanic coating method, for example.

Waveguide 200 may be filled with a medium transparent for radar radiation to protect the conductive coating from corrosion. Largely inert gases, Teflon, various foams or a vacuum, for example, are suitable for this purpose. Either only waveguide 200 is filled with the medium, to which end antenna elements 300, inlet 210 and outlet 220 must be coated with a medium transparent for radar radiation, or alternatively, the entire antenna body 105 may be situated in the desired medium.

Figure 3:
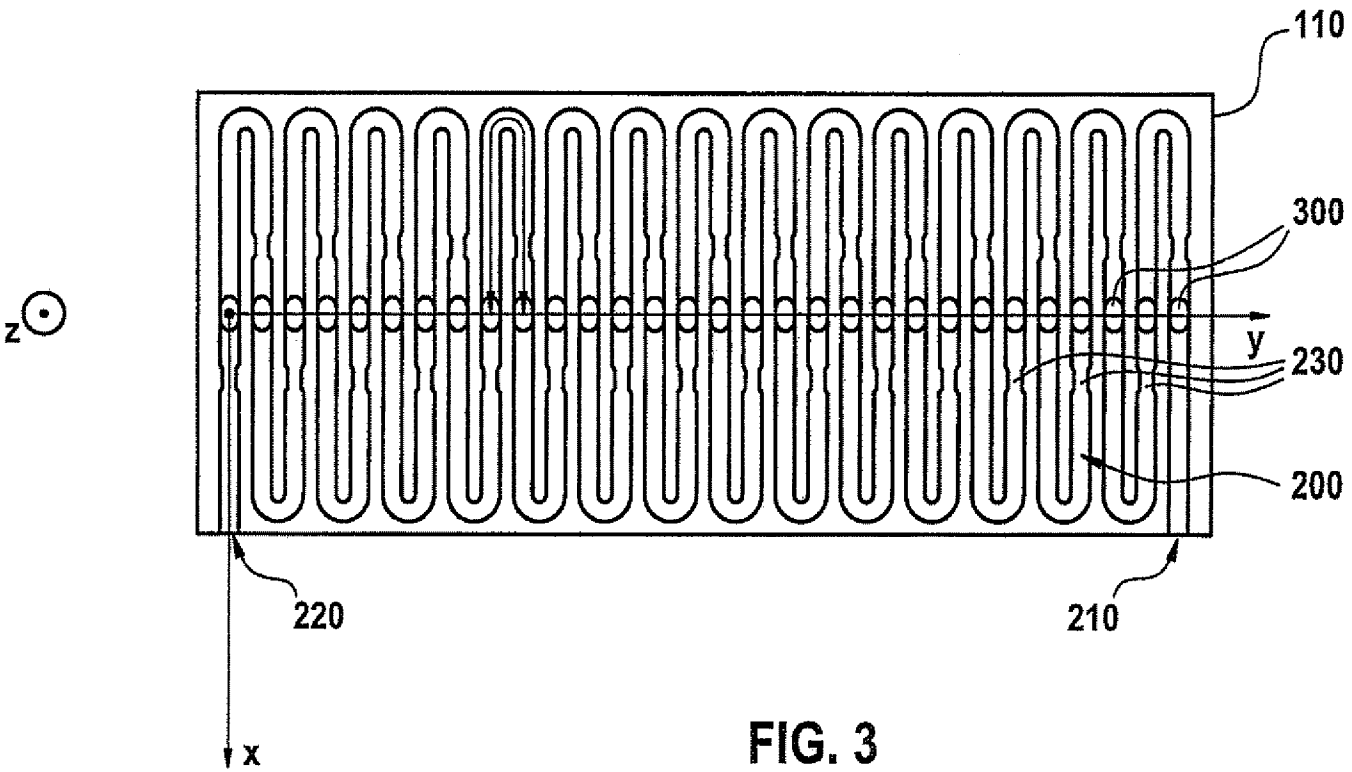
FIG. 3 shows a schematic representation of the waveguide.

FIG. 3 shows another schematic representation of waveguide 200 in the interior of antenna body 105 of antenna 100. Waveguide 200 includes a plurality of sections oriented parallel to the x axis, interconnected in a meandering form by bends so that waveguide 200 extends on the whole in the y direction. First antenna elements 300 are situated along the first straight lines oriented parallel to the y axis. First antenna elements 300, designed as apertures to waveguide 200, represent interference for waveguide 200 and negatively affect its wave conduction properties. To compensate for the interference in waveguide 200 caused by first antenna elements 300, waveguide 200 has a plurality of compensation structures 230. Compensation structures 230 are embodied as taperings of waveguide 200 in the vicinity of apertures forming first antenna elements 300. Compensation structures 230 are of such dimensions that they compensate for the effect of first antenna elements 300 on waveguide 200. Compensation structures 230 may also be situated elsewhere, for example, at a greater distance from the first antenna elements. However, it has proven to be favorable in particular to provide compensation structures 230 as close to first antenna elements 300 as possible. Compensation structures 230 improve the emission properties of antenna 100.

Figure 4:
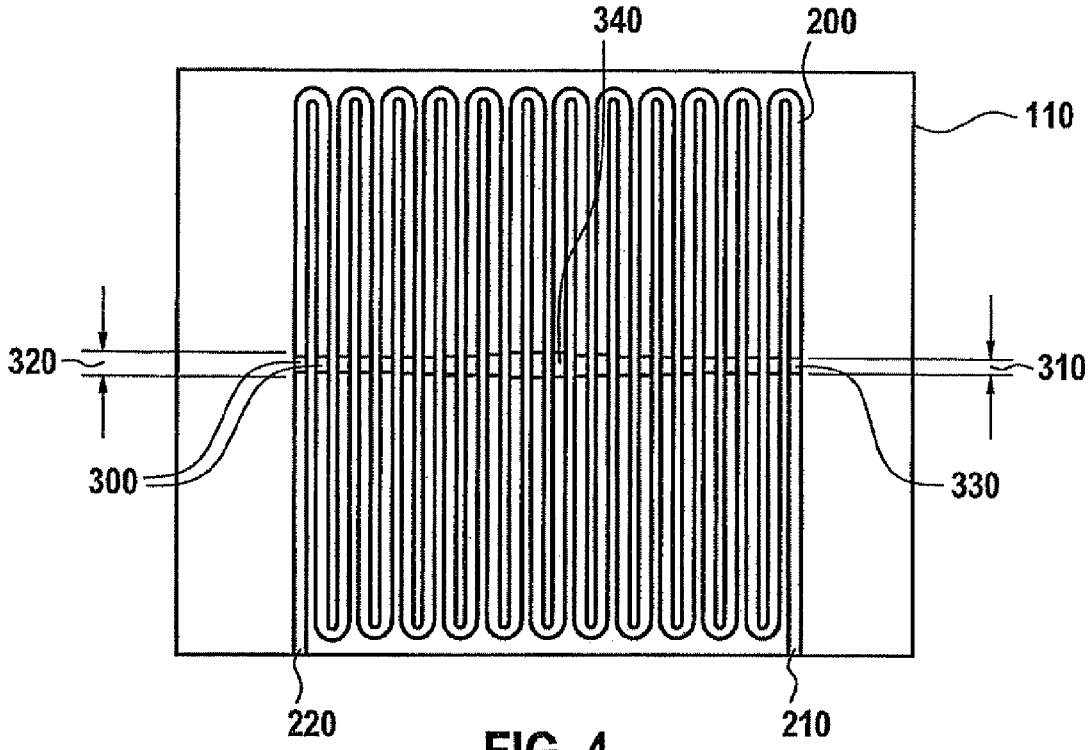
FIG. 4 shows another representation of the waveguide having antenna elements.

FIG. 4 shows another view of top part 110 of antenna body 105 and waveguide 200 situated therein. FIG. 4 shows that the apertures forming first antenna elements 300 have different diameters. The apertures need not be designed to be circular but instead may also have a different shape, for example, a rectangular shape. The term diameter in this context refers to the size of the aperture, regardless of the exact shape of the aperture. An exterior antenna element 330 situated closest to inlet 210 of waveguide 200 has a first diameter 310. A central antenna element 340 situated at the center of waveguide 200 has a second diameter 320. Second diameter 320 is greater than first diameter 310. First antenna elements 300 situated between central antenna element 340 and exterior antenna element 330 have diameters between first diameter 310 and second diameter 320. The diameter of first antenna elements 300 increases toward the center of waveguide 200. This also applies similarly to first antenna elements 300 situated between the center of waveguide 200 and outlet 220 of waveguide 200.

The size of the holes forming first antenna elements 300 determines the power emitted by first antenna elements 300. The distribution of the power emitted by the various first antenna elements 300 is referred to as the antenna configuration. The form of the antenna configuration has a significant influence on the directional characteristic of antenna 100. At a constant configuration at which all first antenna elements 300 emit approximately the same power, the resulting directional characteristic has only a low side-lobe suppression. However, the side-lobe suppression may also be improved through an improved antenna configuration. The directional characteristic of antenna 100 in the far field is obtained from a Fourier transform of the antenna configuration. Thus a suitable antenna configuration is calculable from the desired far field of antenna 100. An antenna configuration at which the emitted power of each first antenna element 300 is approximately proportional to the square of the cosine of the distance of a particular first antenna element 300 from central antenna element 340 normalized to n/2 has proven favorable in particular. The normalized distance of exterior antenna element 330 from central antenna element 340 corresponds to a value of n/2. The power emitted by exterior antenna element 330 is proportional to the square of the cosine of n/2 and is thus equal to zero.

Antenna elements 300 situated between exterior antenna element 330 and central antenna element 340 have a normalized distance from central antenna element 340 of less than n/2 accordingly. Exterior antenna elements 330, which emit a power of zero, may of course also be omitted. However, other antenna configurations are also possible. On the whole, side-lobe suppression of the emitted radiation in the far field of antenna 100 amounting to more than 25 dB is achievable.

The exact diameters of the apertures forming first antenna elements 300 are derived from the desired antenna configuration, and a correction which takes into account the fact that the high-frequency electromagnetic signal is supplied to waveguide 200 at one end through inlet 210. Therefore antenna elements 300 a greater distance away from inlet 210 must have a larger diameter than antenna elements 300 situated close to inlet 210.

Figure 5:
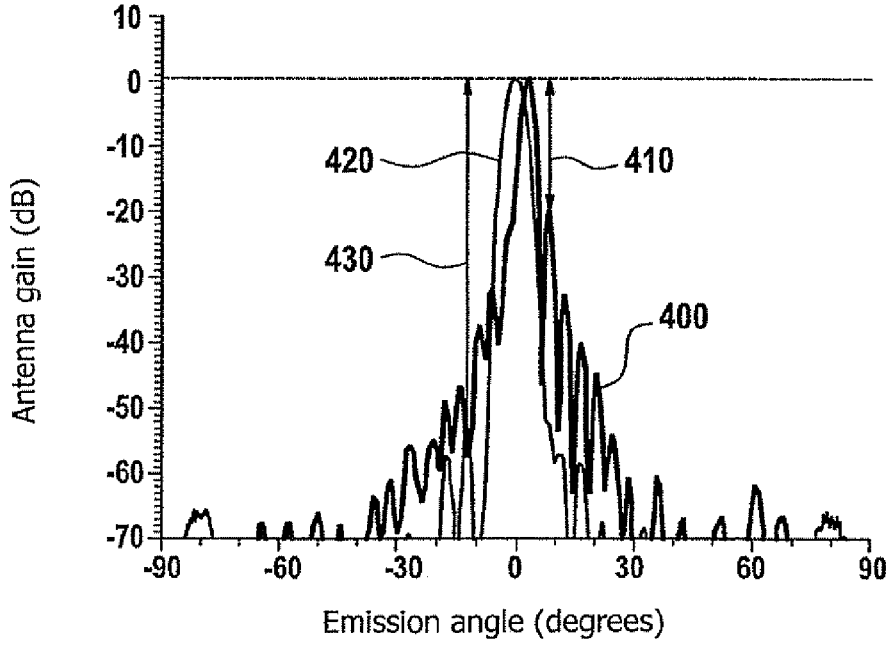
FIG. 5 shows a graphic plot of the emission characteristic of the antenna.

The side-lobe suppression of the signal emitted by the antenna is optimizable, as already explained, by a suitable antenna configuration of first antenna elements 300. FIG. 5 shows in a schematic representation a comparison of the directional characteristics of an antenna 100 having compensation structures 230 described above and an optimized antenna configuration of first antenna elements 300 in comparison with the directional characteristic of an antenna without the optimizations described. The emission angle of the antenna is plotted on the horizontal axis and a normalized antenna gain is plotted on the vertical axis. First directional characteristic 400 of the unoptimized antenna has a first side-lobe suppression 410. A second directional characteristic 420 of optimized antenna 100 has a second side-lobe suppression 430. It is discernible that second side-lobe suppression 430 of optimized antenna 100 is better than first side-lobe suppression 410 of the unoptimized antenna.

Figure 6:
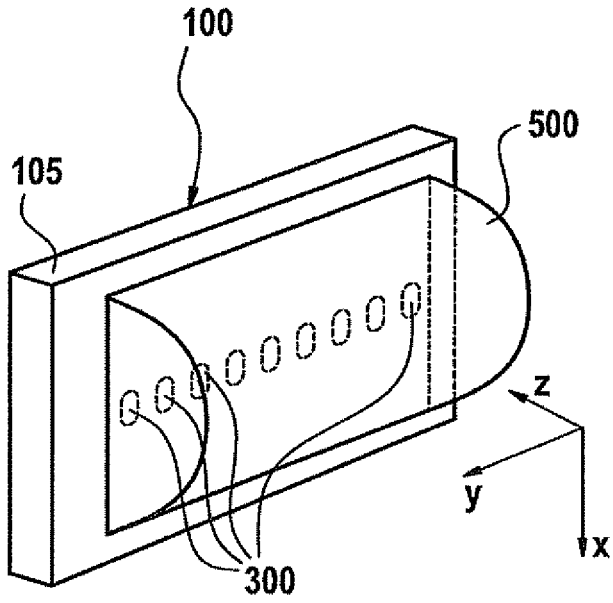
FIG. 6 shows a perspective representation of the antenna having a cylinder lens.

FIG. 6 shows another perspective view of antenna 100 having antenna body 105. First antenna elements 300 of antenna 100 are situated along the first straight line, which is oriented parallel to the y axis. The emission angle of antenna 100 changes in the y-z plane through a variation in the frequency of the high-frequency signal injected into waveguide 200. However, antenna 100 emits in direction x in a wide angle range. Therefore, a lens 500 is situated in front of antenna body 105 in FIG. 6. Lens 500 is in the shape of a cylindrical segment whose longitudinal axis is oriented parallel to the y axis. Lens 500 focuses the beam emitted through antenna 100 in the x direction and thereby increases the gain of antenna 100. The signal emitted by antenna 100 is not altered by lens 500 in the y direction. Lens 500 may be made of various materials. Polyetherimide has proven to be particularly suitable. Lens 500 may increase the antenna gain of antenna 100 by up to 7 dB.

Figure 7:
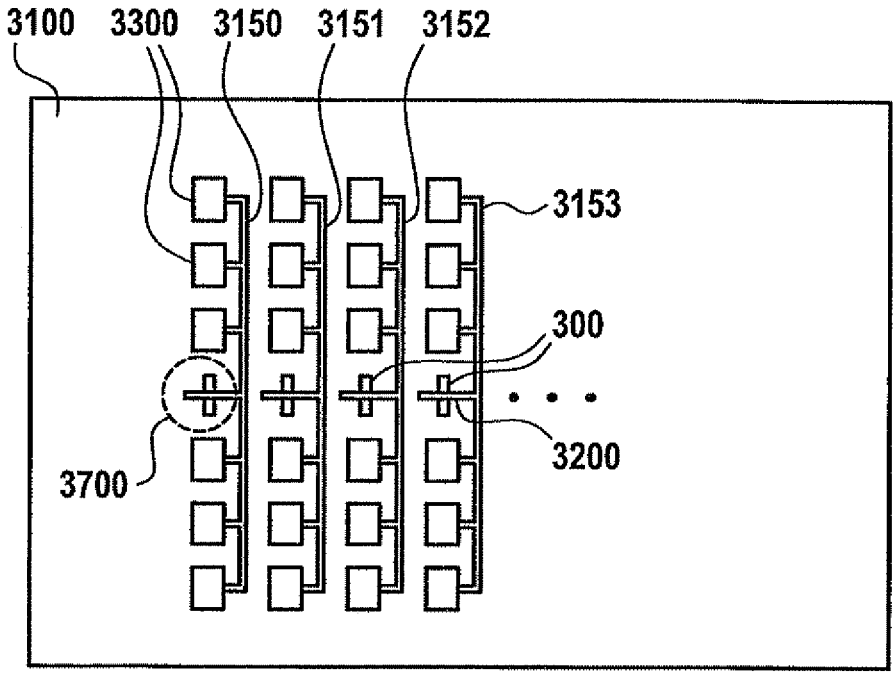
FIG. 7 shows a representation of the antenna having additional antenna gaps according to a first specific embodiment.

FIG. 7 shows a top view of an antenna 3100 according to another specific embodiment. Antenna 3100 also has first antenna elements 300, which are situated along the first straight lines. In addition, antenna 3100 has additional antenna gaps oriented perpendicularly to the first straight lines. FIG. 7 shows a first antenna gap 3150, a second antenna gap 3151, a third antenna gap 3152 and a fourth antenna gap 3153. Antenna 3100 may have as many antenna gaps 3150, 3151, 3152, 3153 as it has first antenna elements 300. Each antenna gap 3150, 3151, 3152, 3153 has a plurality of fifth antenna elements 3300, which are designed as patch elements. In the example in FIG. 7, each antenna gap 3150, 3151, 3152, 3153 has six fifth antenna elements 3300. Fifth antenna elements 3300 of an antenna gap 3150, 3151, 3152, 3153 are interconnected via a microstrip conductor. The microstrip conductor and fifth antenna elements 3300 are made of an electrically conductive material, for example, a metal. In addition, each antenna gap 3150 to 3153 has a coupling web 3200, which is also designed as a microstrip conductor and to which the microstrip conductors connecting fifth antenna elements 3300 are connected. Coupling web 3200 of each antenna gap 3150, 3151, 3152, 3153 is situated above a first antenna element 300 of antenna 3300 and forms with this antenna element 300 a first coupling structure 3700. The power emitted by the respective first antenna element 300 is injected via first coupling structure 3700 into antenna gap 3150, 3151, 3152, 3153, which is coupled to the respective first antenna element 300. Since antenna gaps 3150, 3151, 3152, 3153 are oriented perpendicularly to the first straight lines, antenna gaps 3150, 3151, 3152, 3153 cause the signal emitted by the antenna 3100 to focus perpendicularly to the swiveling plane of antenna 3100. Coupling structures 3700 may be situated in the middle of the respective antenna gaps 3150, 3151, 3152, 3153, as shown in FIG. 7. Alternatively, coupling structures 3700 may also be provided at the edges or in any other positions of antenna gaps 3150, 3151, 3152, 3153.

Figure 8:
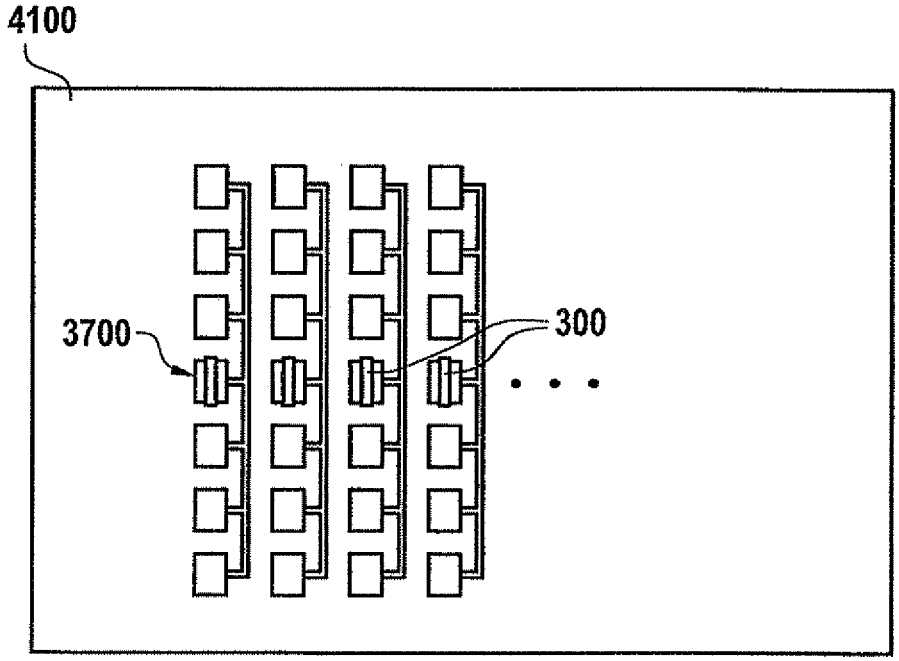
FIG. 8 shows a representation of the antenna having additional antenna gaps according to a second specific embodiment.

FIG. 8 shows a top view of an antenna 4100 according to another specific embodiment. Antenna 4100 also has a plurality of antenna gaps, each being situated above first antenna elements 300 and oriented perpendicularly to the first straight lines. In contrast with antenna 3100 shown in FIG. 7, however, the antenna gaps of antenna 4100 do not have a coupling web 3200. Instead, one of the fifth antenna elements 3100 of each antenna gap is situated above a particular first antenna element 300 and together with it forms the first coupling structure 3700. The power emitted by the particular first antenna element 300 is also injected into the antenna gap situated above the particular first antenna element 300 in this way, resulting in the signal emitted by antenna 4100 to focus perpendicularly to the swiveling direction. Any positions of coupling structures 3700 at the antenna gaps may be selected.

Figure 9:
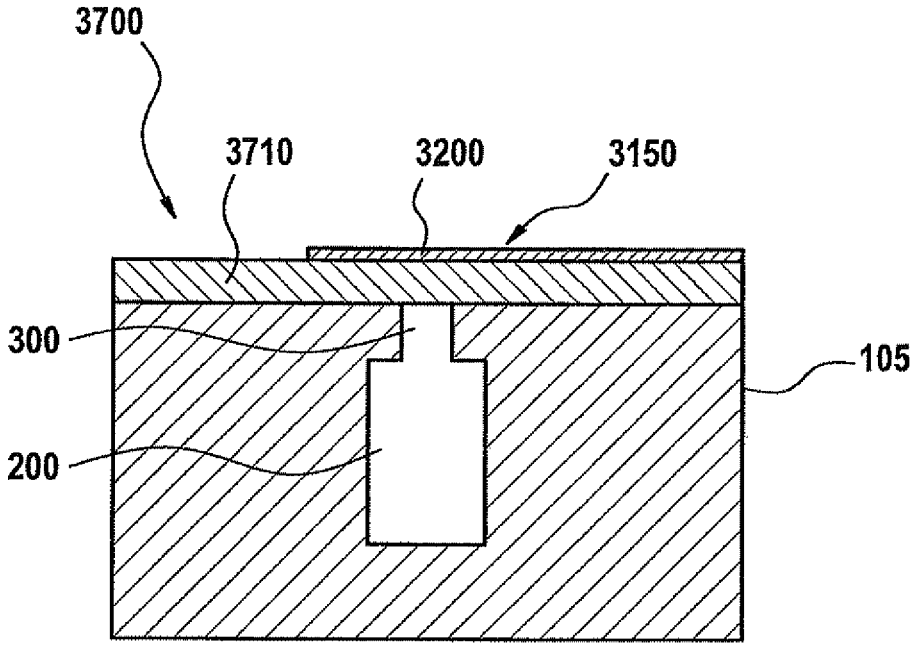
FIG. 9 shows a section through the antenna having an additional antenna gap.

FIG. 9 shows a section through one of the first coupling structures 3700 of antennas 3100 of FIG. 7. It is discernible that a substrate 3710 is situated between first antenna element 300 and coupling web 3200 of antenna gap 3150. Substrate 3710 is made of an electrically insulating material and insulates antenna gaps 3150 electrically from antenna body 105.

Figure 10:
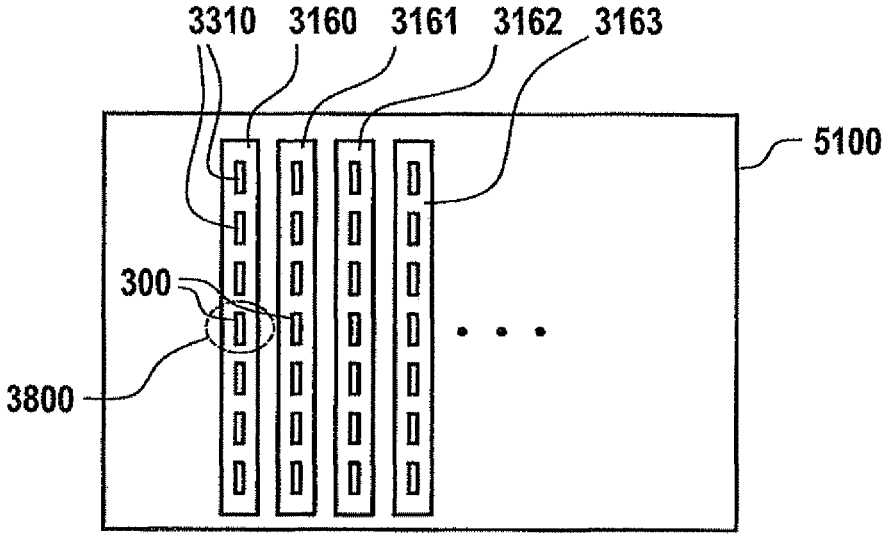
FIG. 10 shows a representation of the antenna having additional antenna gaps according to a third specific embodiment.

FIG. 10 shows a view of an antenna 5100 according to another specific embodiment. Antenna 5100 in turn has a plurality of first antenna elements 300, which are situated along a first straight line. In addition, antenna 5100 has a plurality of antenna gaps 3160, 3161, 3162, 3163, each being oriented perpendicularly to the first straight line and each being situated over one of the first antenna elements 300. Each antenna gap 3160, 3161, 3162, 3163 is designed as a waveguide antenna having a plurality of sixth antenna elements 3310. In a central section of each antenna gap 3160, 3161, 3162, 3163, the particular antenna gap 3160, 3161, 3162, 3163 is coupled to first antenna element 300 below it via a second coupling structure 3800. The power emitted by first antenna elements 300 is therefore injected into antenna gaps 3160, 3161, 3162, 3163, resulting in a focused signal emitted by antenna 5100 perpendicularly to the swiveling direction of antenna 5100.

Figure 11:
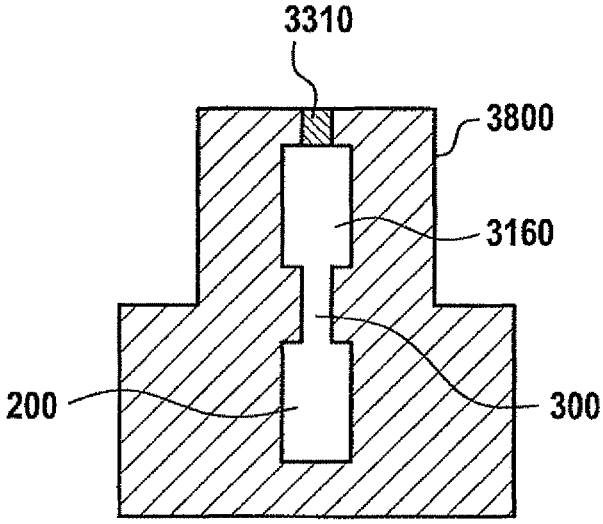
FIG. 11 shows a section through the antenna having additional antenna gaps according to the third specific embodiment.

FIG. 11 shows one of the second coupling structures 3800 in a section through antenna 5100 from FIG. 10. The waveguide of antenna gap 3160 is situated perpendicularly above waveguide 200 of antenna 5100. The waveguide of antenna 5100 is connected to the waveguide of antenna gap 3160 via one of the first antenna elements 300. A sixth antenna element 3310 of antenna gaps 3160 is situated perpendicularly above the waveguides and first antenna element 300. Sixth antenna element 3310 may be designed as an aperture or may be sealed by a dielectric material, for example.

Antennas 3100, 4100, 5100 from FIGS. 7 through 11 have the advantage that the antenna gaps cause the signal emitted by antennas 3100, 4100, 5100 perpendicularly to the particular swiveling direction to be focused without requiring a lens. This reduces the installation space required for antennas 3100, 4100, 5100.

Figure 12:
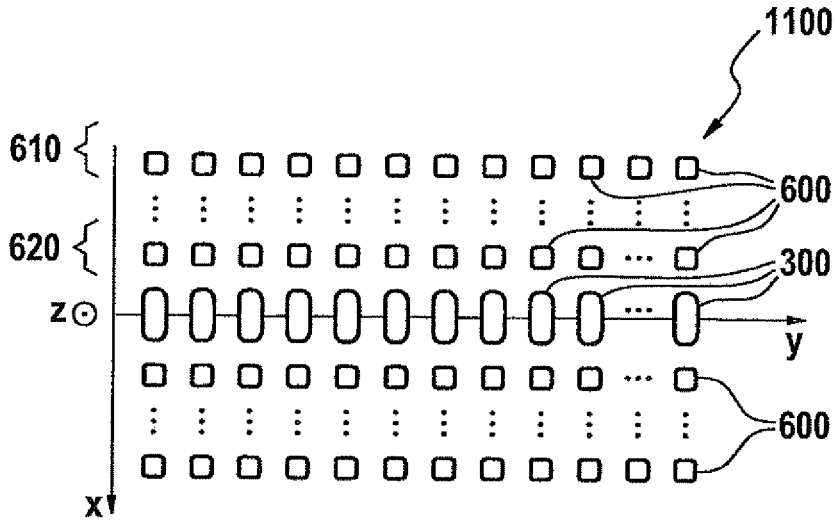
FIG. 12 shows a representation of the antenna having additional patch elements.

FIG. 12 shows a top view of an antenna 1100 according to another specific embodiment. Antenna 1100 also has a plurality of first antenna elements 300, which are situated along a first straight line oriented parallel to the y axis. In addition, antenna 1100 has a plurality of second antenna elements 600 situated in the x direction next to first antenna elements 300. Second antenna elements 600 are situated in rows oriented parallel to the first straight line. FIG. 12 shows as an example a first row 610 and a second row 620. However, other rows having additional second antenna elements 600 may also be present. Second antenna elements 600 are designed as patch elements. Second antenna elements 600 of each row 610, 620 are interconnected via a microstrip conductor. The microstrip conductor is not shown in FIG. 12. Each row 610, 620 thus forms its own patch antenna. Each row 610, 620 may be connected to a separate electronic analyzer. Rows 610, 620 may be used for detecting a reflected radar signal. Since rows 610, 620 are situated next to one another in the x direction, rows 610, 620 of antenna 1100 allow resolution of the reflected radar signal in the x direction, i.e., at a right angle to the swiveling direction of antenna 1100, regardless of the angle. Antenna 1100 may scan the space in front of antenna 1100, i.e., in the y-z plane, by swiveling the radar beam emitted and resolve the reflected radar signal in the x-z plane as a function of angle. Antenna 1100 therefore achieves good angular resolution both vertically and horizontally. Alternatively, second antenna elements 600 may also be used for transmitting.

Figure 13:
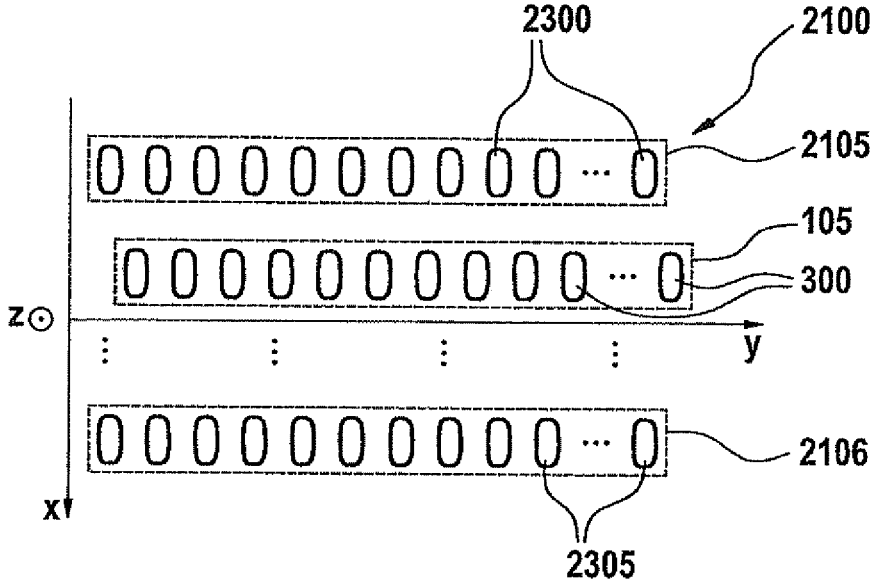
FIG. 13 shows a representation of the antenna having additional antenna bodies.

FIG. 13 shows a view of an antenna 2100 according to another specific embodiment. This antenna has antenna body 105, already explained with reference to FIG. 1, having first antenna elements 300. In addition, antenna 2100 has a second antenna body 2105 and a third antenna body 2106. Antenna 2100 may also have additional antenna bodies. Second antenna body 2105 and third antenna body 2106 correspond in their design to first antenna body 105. Second antenna body 2105 thus has third antenna elements 2300, and third antenna body 2106 has fourth antenna elements 2305. First antenna elements 300, third antenna elements 2300 and fourth antenna elements 2305 are each oriented parallel to the y axis. The antenna elements of various antenna bodies 105, 2105, 2106 may be situated either directly one above the other or side-by-side next to one another in the x direction.

Antenna 2100 may be used in various ways. Individual antenna bodies 105, 2105, 2106 may be supplied by a common high-frequency source, so that individual antenna elements 105, 2105, 2106 emit synchronously with one another. In this case, the partial beams emitted by individual antenna bodies 105, 2105, 2106 may interfere with one another, resulting in a focused radar beam emitted by antenna 2100 in the y-z plane. The function of antenna 2100 corresponds to that of antennas 3100, 4100, 5100 of FIGS. 7, 8 and 10.

A second possibility for using antenna 2100 is to use only first antenna body 105 for emitting radar beams and to detect the reflected radar signal with the aid of second antenna body 2105 and third antenna body 2106. Antenna 2100 then achieves an angular resolution at a right angle to the swiveling direction of antenna 2100. This corresponds to the function of antenna 1100 of FIG. 12.

Figure 14:
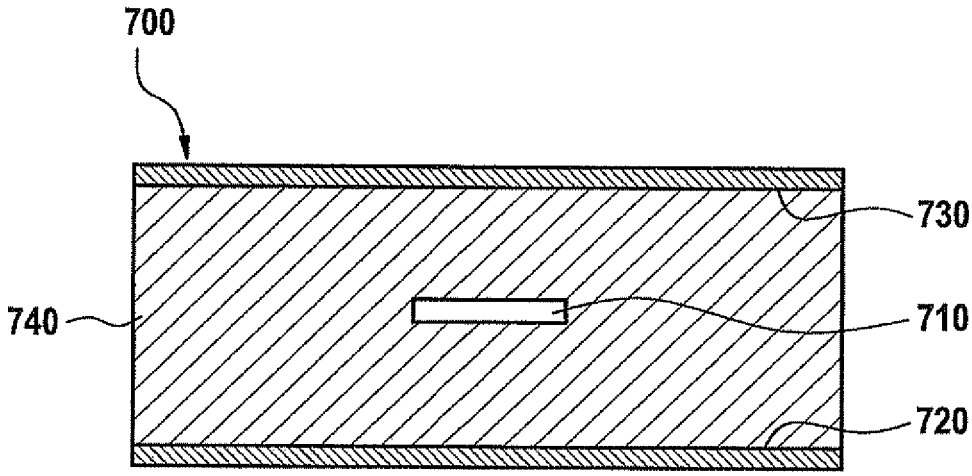
FIG. 14 shows a representation of a waveguide designed as a strip conductor.

The antennas of the specific embodiments described so far each use a waveguide 200 having apertures which form first antenna elements 300. However, a strip conductor may also be used instead of antenna body 105 and waveguide 200. FIG. 14 shows a suitable strip conductor 700 in a schematic sectional representation. Strip conductor 700 has a first grounded surface 720 and a second grounded surface 730. First grounded surface 720 and second grounded surface 730 are each made of an electrically conductive material, for example, a metal. First grounded surface 720 and second grounded surface 730 may be electrically short-circuited. Both grounded surfaces 720, 730 extend in one plane and are situated essentially parallel to one another. A dielectric 740 is situated between first grounded surface 720 and second grounded surface 730. The dielectric may have a low relative dielectric constant. The dielectric may be Teflon or a foam-type material, for example.

A signal conductor 710 is embedded in dielectric 740. Signal conductor 710 is made of an electrically conductive material, for example, a metal. The signal conductor extends essentially along one direction. Signal conductor 710 need not necessarily be centered in the middle between first grounded surface 720 and second grounded surface 730. Another dielectric may also be provided between signal conductor 710 and first grounded surface 720 rather than between signal conductor 710 and second grounded surface 730. Signal conductor 710 and grounded surfaces 720, 730 may jointly transmit a high-frequency electromagnetic signal.

Strip conductor 700 may replace antenna body 105 having waveguide 200 or may function as an alternative antenna body. In this case, first ground surface 720 and/or second ground surface 730 have one or more apertures functioning as antenna elements. The antenna elements formed in this way correspond to first antenna elements 300 of antenna 100 in FIG. 1. Signal conductor 710 may run in a meandering pattern like waveguide 200 or in a straight line between the apertures forming the antenna elements in first ground surface 720 and/or second ground surface 730.

The further refinements described on the basis of FIGS. 3 to 13 may be combined with an antenna based on strip conductor 700. Thus the apertures forming the antenna elements may have different diameters in first ground surface 720 and/or second ground surface 730 to optimize the antenna configuration, as described on the basis of FIGS. 4 and 5. Signal conductor 710 may have compensation structures, as in FIG. 3, which compensate for a disturbance caused by reflection on the antenna elements. Cylindrical lens 500 may also be combined with strip conductor 700. Additional antenna gaps may also be provided on the surface of the strip conductor.

THE LIST OF REFERENCE NUMERALS IS AS FOLLOWS:

100 antenna
105 antenna body
110 top part of the antenna body
120 bottom part of the antenna body
200 waveguide
210 inlet
220 outlet
230 compensation structure
300 first antenna elements
310 first diameter
320 second diameter
330 exterior antenna element
340 central antenna element
400 first directional characteristic
410 first side-lobe suppression
420 second directional characteristic
430 second side-lobe suppression
500 lens
600 second antenna elements
610 first row
620 second row
700 strip conductor
710 signal conductor
720 first grounded surface
730 second grounded surface
740 dielectric
1100 antenna
2100 antenna
2105 second antenna body
2106 third antenna body
2300 third antenna elements
2305 fourth antenna elements
3100 antenna
3150 first antenna gap
3151 second antenna gap
3152 third antenna gap
3153 fourth antenna gap
3160 antenna gap
3161 antenna gap
3162 antenna gap
3163 antenna gap
3200 coupling web
3300 fifth antenna elements
3310 sixth antenna elements
3700 first coupling structure
3710 substrate
3800 second coupling structure
4100 antenna
5100 antenna

What is claimed is:

1. An antenna, comprising:

an antenna body including a plurality of first antenna elements situated along a first straight line, the antenna body including a first conductive grounded surface and a second conductive grounded surface, the first and second grounded surfaces being situated essentially parallel to one another;

a dielectric situated between the first and second grounded surfaces;

a signal conductor situated between the first and second grounded surfaces; and an inlet for injecting a supply signal onto the signal conductor and an outlet for extracting the supply signal from the signal conductor;

wherein the first antenna elements are configured as apertures situated above the signal conductor in the first grounded surface, wherein the antenna is configured to emit a signal in a spatial direction, the spatial direction being a function of a frequency of the signal, and wherein at least two of the first antenna elements differ from one another so that their power emissions are different.

2. The antenna of claim 1, wherein the power emitted by the first antenna elements interferes so that side-lobe suppression of the emitted power in the far field amounts to more than 25 dB.

3. The antenna of claim 1, wherein the first antenna elements include an exterior antenna element and a central antenna element, wherein the aperture forming the exterior antenna element has a first diameter, wherein the aperture forming the central antenna element has a second diameter, and wherein the first diameter and the second diameter are different from one another.

4. The antenna of claim 1, wherein the first antenna elements include a central first antenna element, and wherein the power emitted by a first antenna element is approximately proportional to the square of the cosine of the distance of this first antenna element from the central first antenna element normalized to $\pi/2$.

5. The antenna of claim 1, wherein the signal conductor has at least one compensation structure, which is configured so that an interference of the signal conductor caused by the first antenna elements is compensated.

6. The antenna of claim 1, further comprising:

a lens having the shape of a cylindrical segment, wherein a longitudinal axis of the lens is oriented parallel to the first straight line, and wherein the lens is made of a dielectric material.

7. The antenna of claim 6, wherein the lens is made of polyetherimide.

8. The antenna of claim 1, further comprising:

a plurality of second antenna elements situated outside of the first straight lines, the second antenna elements being patch elements, at least two of the second antenna elements being interconnected by a microstrip conductor.

9. The antenna of claim 8, wherein the second antenna elements are situated in a row, which is oriented parallel to the first straight line, and wherein the second antenna elements in the row are interconnected by a microstrip conductor.

10. The antenna of claim 1, further comprising:

a second antenna body having a plurality of third antenna elements, which are situated along a second straight line, the second straight line being oriented parallel to the first straight line;

a waveguide situated in the second antenna body which runs between the third antenna elements, wherein the third antenna elements are configured as apertures running between the waveguide and a surface of the second antenna body.

11. The antenna of claim 1, further comprising:

at least one antenna gap having a plurality of fifth antenna elements, wherein the antenna gap is oriented perpendicularly to the first straight line, and wherein the antenna gap is coupled to a first antenna element via a coupling structure.

12. The antenna of claim 11, wherein the antenna gap is configured as a microstrip conductor antenna, and wherein the fifth antenna elements are configured as patch elements.

13. The antenna of claim 12, further comprising:

a substrate provided between the antenna body and the antenna gap.

14. The antenna of claim 11, wherein the antenna gap is configured as a waveguide and the fifth antenna elements are configured as apertures in this waveguide.

* * * * *